US006165667A

United States Patent [19]

Takagi et al.

[11] Patent Number: 6,165,667

[45] Date of Patent: Dec. 26, 2000

[54] IMAGE-FORMING TONER, PREPARATION METHOD THEREOF, THREE-DIMENSIONAL IMAGE-FORMING METHOD AND IMAGE-FORMING APPARATUS

[75] Inventors: Seiichi Takagi; Reiko Akiyama; Isamu Suzuki, all of Minamiashigara; Nobuyuki Naito, Iwatsuki; Yuichi Murayama, Ebina, all of Japan

[73] Assignee: Fuji Xerox Co., Ltd., Tokyo, Japan

[21] Appl. No.: 09/387,851

[22] Filed: Sep. 1, 1999

[30] Foreign Application Priority Data

Oct. 26, 1998 [JP] Japan ..... 10-304458

[51] Int. Cl.[7] ..... G03G 9/097

[52] U.S. Cl. ..... 430/110; 430/111; 430/137; 399/297

[58] Field of Search ..... 430/45, 106, 109, 430/111, 137; 399/297

[56] References Cited

U.S. PATENT DOCUMENTS

| | | | |
|---|---|---|---|
| 4,540,644 | 9/1985 | Jacob | 430/110 |
| 5,122,430 | 6/1992 | Nishitsuji et al. | 430/110 |
| 5,563,694 | 10/1996 | Katayama | 430/126 |

FOREIGN PATENT DOCUMENTS

| | | |
|---|---|---|
| 52-28325 | 3/1977 | Japan . |
| 59-35359 | 8/1984 | Japan . |
| 61-72589 | 4/1986 | Japan . |
| 4-333858 | 11/1992 | Japan . |
| 7-61047 | 3/1995 | Japan . |
| 8-60054 | 3/1996 | Japan . |
| 8-63039 | 3/1996 | Japan . |

*Primary Examiner*—John Goodrow
*Attorney, Agent, or Firm*—Oliff & Berridge, PLC

[57] ABSTRACT

A three-dimensional image-forming toner containing at least a binder resin and a foaming agent in such a manner that the foaming agent is not substantially exposed to the surface of the toner. The foaming agent is preferably microcapsule particles containing a low-boiling substance such as, preferably, isobutane, and the shell material of the microcapsule is preferably a copolymer of vinylidene chloride and acrylonitrile.

By using the image-forming toner, a three-dimensional image having a sufficient image thickness for being recognized as Braille types and a good fixing property to a recording medium such as a plain paper can be easily formed using an ordinary electrophotographic copying machine or printer.

11 Claims, 3 Drawing Sheets

IMAGE-FORMING TONER A OF THE INVENTION A

RELATED ART SOLID IMAGE-FORMING TONER A'

IMAGE-FORMING TONER, PREPARATION METHOD THEREOF, THREE-DIMENSIONAL IMAGE-FORMING METHOD AND IMAGE-FORMING APPARATUS

FIELD OF THE INVENTION

The present invention relates to an image-forming toner, a method of preparation thereof, and a method of forming a three-dimensional image and an image-forming apparatus using the toner. More specifically, the invention relates to an image-forming toner suitably used for forming a three-dimensional image using an electrostatic process, etc., a method of the preparation of the toner, and a method of forming a three-dimensional image and an image-forming apparatus using the toner.

BACKGROUND OF THE INVENTION

As the materials for propagation and education, materials of a three-dimensional image have been used. The three-dimensional image is useful because the image not only gives plane visual information but also gives three-dimensional information by the shades and the feeling of finger and give a strong impression and understanding. As the particularly effective using manner, there are Braille types and Braille images. The three-dimensional image is used not only as language information but also image information such as a map, etc., and are indispensable for a blind person.

As a method of forming a three-dimensional image, following method have hitherto been known.

For example, for the preparation of Braille types, etc., a method of forming projections on the surface of a paper by embossing working using a type writer for Braille type has been widely used. Also, as a method of duplicating a three-dimensional image and preparing a Braille book, etc., there is a method of using a zinc sheet having formed thereon Braille images by the same principle as the above-described type writer for Braille type as the original plate and duplicating the Braille images using a Braille type plate-making machine or a Braille printing machine. Also, as a method of preparing pamphlets, etc., of a three-dimensional image, there is a method of convexly printing using a ultraviolet-curing high-viscosity polymer ink by utilizing a printing technique such as an ordinary silk screen, etc., but the method is not a method which can be simply used in general offices, etc.

The three-dimensional image forming methods of the related art described above have the faults that a long time is required and further the using place is limited. Furthermore, in the case of duplicating a three-dimensional image, the process of making duplicates and the apparatus used therefor are complicated and become a large scale and the method is unsuitable for the present information-oriented society. Recently, office instruments have been greatly progressed and in particular, by the progress and spreading of personal computers, the preparation of material becomes quick and easily and the output instruments are being attained small sizing, light weighting, cost lowering, high speeding, and coloring thereof. Also, about the three-dimensional image, the development of the instrument capable of easily outputting and duplicating a three-dimensional image has been desired. In particular, if it becomes possible to obtain at a low cost a software capable of converting ordinary letters (plane letter) into Braille letters or reverse converting of them, the participation of blind persons to society can be further accelerated. Also, to expand the possibility of the exchange of electronic mails in blind persons each other, an output apparatus capable of easily outputting Braille letters, etc., is necessary.

That is, it is the actual situation that in the output and the duplicate of a three-dimensional image, the development of an easy and high-speed system corresponding to the office environment at present has been desired in place of a conventional complicated and large system.

On the other hand, in JP-A-8-60054, an ink jet ink containing a ultraviolet decomposition type gas-generating photosensitive compound, and apparatus using the ink, and a method of forming a three-dimensional image using it are proposed. Because the output apparatus disclosed in the specification of the above-described patent application is a small-sized apparatus and also the output from a personal computer is possible, the method proposed is an effective method of forming a three-dimensional image. However, there is a problem that when a three-dimensional image is intended to output on a plain paper, the liquid ink permeates into the fibers of the paper and when the images are expanded with ultraviolet rays, sufficient a three-dimensional image is not obtained. Accordingly, it is proposed to use a non-liquid-absorbing recording material such as PET, etc., but the use of such a material is expensive and is unsuitable for bookbinding, whereby the practical use is difficult.

Thus, as a method of easily forming a three-dimensional image, a method of using an electronic photographic system which is widely used in offices and for personal computers has been proposed. For example, in JP-B-59-35359 and JP-A-61-72589, a method of using a thermally expanding sheet is proposed. This is the method of uniformly coating a thermally expanding material on a support such as a paper, etc., and thermally expanding the imaged portions only to prepare a three-dimensional image. According to the method, an ordinary copying machine can be utilized, the thermally expanding sheet is used in place of an ordinary plain paper, images of a black toner are formed on the sheet, and the thermally expanding material under the toner images are expanded by utilizing the heat-absorbing property of the black toner to form a three-dimensional image. This method is preferred in the point of easily forming a three-dimensional image but is not preferred from the points that a black toner is required for sufficiently thermally expanding the thermally expanding material, other heating apparatus is required, a considerably long time is required to form a three-dimensional image having a sufficient image thickness, and further it is necessary to coat the thermally expanding material on the whole surface of the sheet, which is against the requirement of resource saving. Moreover, the sheet is thick, which is unsuitable to bookbinding using many sheets, and thus it is difficult to use the method for practical purpose.

On the other hand, in JP-A-4-333858 and JP-A-8-63039, a method of using a conventional electrophotographic system and forming a three-dimensional image by increasing the amount of the toner on the images is proposed. However, because the method is a method of increasing the height of the images by forming the toner images using a large amount of a conventional toner, there is a problem that fixing of the toner to a paper, etc., becomes insufficient and, on the other hand, when fixing is carried out at a high temperature to make fixing sufficient, the toner is melted and permeates into the fibers of the paper, whereby the height of the images becomes insufficient.

Furthermore, in JP-A-52-28325, an electrophotographic toner containing a dry intumescing agent is proposed. In the method, a toner obtained by powder-mixing a conventional toner and the above-described intumescing agent is used and after image forming, the dry intumescing agent is expanded by heat to obtain a three-dimensional image. However, because by powder-mixing, the toner and the intumescing agent cannot be sufficiently uniformly mixed, it frequently happens that the intumescing agent without having an adhesive force exists at the boundary surface of toner and the paper, whereby the a three-dimensional image having a sufficient fixing property are not obtained. Also, because the adhesive property of toner particles and the intumescing agent is insufficient, to increase the adhesive property, a method of incorporating the dry intumescing agent in the toner (in this case, the intumescing agent incorporated in the toner intumesces by heat-kneading at the preparation of the toner, whereby the agent loses the thermal expanding property) and further powder-mixing the toner with the remaining dry intumescing agent to improve the adhesive property of the toner particles and the intumescing agent is proposed. However, by the method, the adhesive property of the paper and the toner is not improved and the fixing property of the images and the paper is yet insufficient. Also, because in general, the electrostatic charging property of a binder resin is different from that of the dry intumescing agent, from the difference in the electrostatic charging property, the charge distribution of the toner becomes wide and with the change of an environment, the quality of the images obtained is lowered by using the toner for a long period of time.

Also, in JP-A-7-061047, an inlet and outlet method of information for forming projected images using a toner containing a heat-sensitive foaming agent is proposed. The toner used in the method is prepared by mixing a binder resin for toner, a coloring agent, and a heat-resisting foaming agent and finely grinding the mixture and the heat-sensitive foaming agent is exposed on the surface of the ground toner, whereby there is a portion of existing the heat-resisting foaming agent at the boundary surface of the paper and the toner as the in the case of the above-described method, the adhesive property of the toner and the paper is lowered, and the fixing property of the images made of the above-described toner is inferior. Also, because the heat-resisting foaming agent is exposed on the surface of the toner, the electrostatic charging property on the surface of the toner become nonuniform. Accordingly, the electrostatic charge distribution of the toner becomes wide and when the toner is used under a low-temperature low-humidity environment or when the toner is used for a long period of time, quality lowering such as the occurrence of fog, etc., on the images occurs. Also, because the toner used is prepared by an ordinary kneading and grinding method, it is considered that the greater part of the heat-resisting foaming agent lose the effect by the heat at kneading. As the result thereof, because the foaming agent cannot be sufficiently expanded by heat fixing only of an ordinary copying machine, etc., it is necessary to pass the outputted images through other heating apparatus, and thus the method is insufficient in the point of simplicity.

As described above, it is the actual circumstances that a toner capable of easily forming a three-dimensional image by a copying machine or a small-sized printer (without need of other heating apparatus, etc., and without need of substantial reconstruction) of an ordinary electrophotographic system does not exist. Also, it is the actual circumstances that a toner capable of easily forming images having the image height which can be sufficiently recognized as Braille type and also having a good fixing property even on a plain paper does not exist. Furthermore, it is the actual circumstances that an image-forming toner having a sufficiently good productivity for practical use, an electrostatic charging uniformity, and an environmental stability does not exist.

SUMMARY OF THE INVENTION

The 1st object of this invention it to provide a novel image-forming toner capable of easily forming a three-dimensional image in the case of being used in a general copying machine or printer without giving the above-described problems and undesirable points and to provide a method of preparing the toner.

The 2nd object of this invention is to provide an image-forming toner capable of forming a three-dimensional image having an image height which can be sufficiently recognized as Braille style for practical use and capable of forming a three-dimensional image having a sufficient fixing property and imaging property for practical use and to provide a method of preparing the toner.

The 3rd object of this invention is to provide a novel image-forming toner corresponding to resource saving and to provide a method of preparing the toner.

The 4th object of this invention is to provide a novel image-forming toner capable of also forming, if necessary, ordinary images (plane images) by changing a simple parameter of an ordinary copying machine or a printer in the case of forming a three-dimensional image and to provide a method of preparing the toner.

The 5th object of this invention to provide a three-dimensional image forming toner excellent in the electrostatic charging stability, the environmental stability, and the productivity and to provide a method of preparing the toner, The 6th object of this invention is to provide a method of easily forming a three-dimensional image and also an easy image-forming apparatus utilizing the method.

As the result of making various investigations for attaining the above-described objects, the present inventors have found that the above-described objects can be attained by the image-forming toner described below and have accomplished the present invention.

That is, a 1st aspect of this invention is an image-forming toner containing at least a binder resin and a foaming agent, wherein the forming agent is not substantially exposed on the surface of the toner. Because in the toner of this invention, the foaming agent is not substantially exposed on the surface of the toner, the foaming agent does not exist at the boundary surface of a recording medium such as a paper, etc., and the toner and thus the foaming agent does not hinders the adhesive property of the toner to the recording medium. Accordingly, the images formed by the toner of this invention have a good fixing property. Also, because in the toner of this invention, the foaming agent is not substantially exposed to the surface of the toner, there is no nonuniformity in the electrostatic charging property, whereby the toner shows a high charging stability, and when the toner of this invention is used as a toner for developing electrostatic latent images, the toner shows a good developing property and a transferring property.

It is preferred that the above-described foaming agent is microcapsule particles encapsulating a low-boiling substance because the thermal expansibility of the toner is improved. Also, the above-described low-boiling substance is preferably isobutane because in this case, the thermal expansibility is more improved. Furthermore, it is also preferred that the shell material of the above-described microcapsule particles is a copolymer of vinylidene chloride and acrylonitrile because the adhesive property of the binder resin and the foaming agent is improved.

Also, a 2nd aspect of this invention is a method of preparing an image-forming toner including a step of suspension-dispersing an oil phase formed by dissolving or dispersing at least a binder resin and a foaming agent in a solvent in an aqueous phase to prepare particles comprising the above-described oily phase and a step of removing the solvent from the particles.

A 3rd aspect of this invention is a method of preparing an image-forming toner including a step of suspension polymerizing a monomer for a binder resin having dissolved or dispersed therein at least a foaming agent in an aqueous phase.

According to these preparation methods, the above-described toner can be easily prepared.

A 4th aspect of this invention is a method of forming a three-dimensional image including a step of fixing images made of a toner formed on a recording medium, wherein the above-described toner is a toner containing at least a binder resin and a foaming agent, said foaming agent being not substantially exposed on the toner surface, and in the fixing step or after the fixing step, the foaming agent contained in the toner foams.

Also, a 5th aspect of this invention is a method of forming a three-dimensional image including a developing step of developing latent images formed on an electrostatic latent image holder with a toner to form toner images, a transfer step of transferring the toner images onto a recording medium, and a fixing step of fixing the toner images onto the recording medium, wherein the above-described toner contains at least a binder resin and a foaming agent, and in the above-described fixing step, the foaming agent contained in the toner foams to form a three-dimensional image on the recording medium.

Furthermore, a 6th aspect of this invention is a method of forming a three-dimensional image including a developing step of developing electrostatic latent images using plural developing means and forming plural toner images on a recording medium, wherein a developer made of a toner containing at least a binder resin and a foaming agent is used for at least one developing means. In this aspect, a desired developing means is selected from the plural developing means to proceed the development, thereby selectively forming a three-dimensional image.

Also, a 7th aspect of this invention is an image-forming apparatus comprising a developing means of developing a latent image formed on an electrostatic latent image holder with a toner to form a toner image, a transfer means of transferring the toner image onto a recording medium, and a fixing means of fixing the toner image onto the recording medium, when a three-dimensional image is formed by the image-forming apparatus, the above-described toner is a toner containing at least a binder resin and a foaming agent, said foaming agent being not substantially exposed to the toner surface, and the foaming agent foams by the above-described fixing means to form a three-dimensional image on the recording medium.

DETAILED DESCRIPTION OF THE INVENTION

Figure 1:
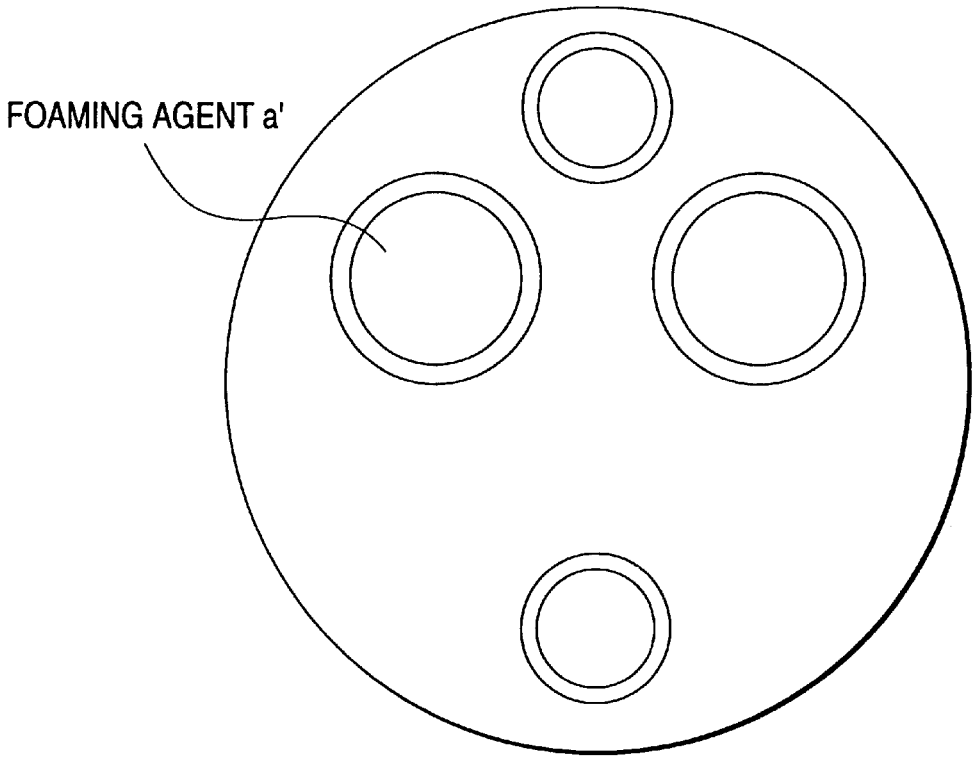
FIG. 1 is an enlarged schematic cross-sectional view showing an embodiment of an image-forming toner of this invention.

Then, the present invention is described below in detail.

1. Image-forming toner

The image-forming toner of this invention is an image-forming toner, wherein the toner contains at least a binder resin and a foaming agent and the foaming agent is not substantially exposed to the surface of the toner.

There is no particular restriction on the foaming agent and any foaming agents which cause volume expansion by heat can be used. The foaming agent may be a three-dimensional or a liquid at normal temperature. Also, the foaming agent is not limited to a material made of a single substance but may be a material made of plural substances and a functional material such as microcapsule particles. About the foaming temperature of the foaming agent, the preferred temperature range differs according to the apparatus used for forming a three-dimensional image but in the case of forming a three-dimensional image using an ordinary copying machine, etc., the foaming temperature is preferred to be not higher than the heat-fixing temperature.

As the foaming agent, a foaming agent made of a substance generating a gas by causing a thermal decomposition as the main constituent can be used and practical examples thereof include hydrogencarbonates such as sodium hydrogencarbonate, etc., generating a gas by the thermal decomposition thereof; a mixture of $NaNO_2$ and $NH_4Cl$ and azo compounds such as azobisisobutyronitrile, diazoaminobenzene, etc., generating a nitrogen gas; and peroxides generating an oxygen gas.

As other embodiment of the foaming agent, there is a foaming agent of microcapsule particles (hereinafter, sometimes called "microcapsule-type foaming agent") containing a substance having a low-boiling temperature (which may be a solid state or a liquid state at a normal temperature) evaporating at a low temperature. The microcapsule-type foaming agent is preferred because of the high foaming property. In the case of using the image-forming toner of this invention containing the microcapsule-type foaming agent in an ordinary copying machine, it is necessary that the low-boiling substance contained in the microcapsules is evaporated at a temperature lower than at least the heat-fixing temperature, and practically the low-boiling substance is a substance at a temperature of 100° C. or lower, preferably 50° C., or more preferably 25° C. or lower. However, because the heat respondence of the microcapsuletype foaming agent depends upon only the boiling point of the low-boiling substance, which is the core material, but also the softening point of the shell material, the preferred boiling point range of the low-boiling substance is not limited to the above-described range. Examples of the low-boiling substance include neopentane, neohexane, isopentane, isobutylene, and isobutane. In these substances, isobutane which is stable to the shell material of the microcapsule and has a high thermal expansion coefficient is preferred.

As the shell material of the microcapsule, a material which has a solvent resistance to various solvents used in the production process of the toner and also has an impermeability to the gas in the case of evaporating the low-boiling substance contained in the microcapsule is preferred. Also, in the case of using the image-forming toner of this invention containing the microcapsule type foaming agent in an ordinary copying machine, it is necessary that the shell material of the microcapsule is softened and expands at a temperature lower than the heat-fixing temperature. As the shell material of the microcapsule, shell materials which have hitherto been used can be widely used. For example, homopolymers such as polyvinyl chloride, polyvinyl acetate, polystyrene, polyacrylonitrile, polybutadiene, and a polyacrylic acid ester and the copolymers of them are preferably used. In these materials, a copolymer of vinylidene chloride and acrylonitrile is preferred in the points of the high adhesive property with a binder resin and the high solvent resistance to solvents.

The preferred range of the content of the foaming agent in the toner of this invention differs according to the kind of the foaming agent but is usually from 5% by weight to 50% by weight, and preferably from 10% by weight to 40% by weight. If the content is less than 5% by weight, it sometimes happens that the thermal expansion of the toner becomes insufficient for practical use and on the other hand, if the content exceeds 50% by weight, there sometimes occurs the problems that the content of the binder resin in the toner is relatively insufficient and a sufficient fixing property is not obtained.

There is no restriction on the binder resin of the three-dimensional image-forming toner of this invention and resins generally used as binder resins for toners can be used. Practical examples of the binder resin include polyester resins, styrene resins, acrylic resins, styrene-acryl resins, ethylene-vinyl acetate resins, silicone resins, epoxy resins, diene-based resins, phenol resins, and ethylene-vinyl acetate resins and in these resins polyester resins are more preferred. As the polymerizable monomers of polyester resins, there are following monomers. That is, as an alcohol component, there are the diols of polyoxypropylene(2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2-bis(4-hydroxyphenyl)propane, polyoxypropylene(2,0)-polyoxyethylene(2,0)-2,2-bis(4-hydroxyphenyl)propane, etc.; ethylene glycol, diethylene glycol, triethylene glycol, polyethylene glycol, propylene glycol, dipropylene glycol, isopentyl glycol, hydrogenated bisphenol A, 1,3-butanediol, 1,4-butanediol, neopentylglycol, xylylene glycol, 1,4-cyclohexane dimethanol, glycerol, trimethylolethane, trimethylolpropane, pentaerythritol, bis(β-hydroxyethyl) terephthalate, tris-(β-hydroxyethyl) isocyanurate, 2,2,4-trimethylolpentane-1,3-diol, etc. Furthermore, a hydroxycarboxylic acid component can be added thereto. For example, there are p-oxybenzoic acid, vanillic acid, dimethylolpropionic acid, malic acid, tartaric acid, and 5-hydroxy-isophthalic acid.

Practical examples of the acid component include malonic acid, succinic acid, glutaric acid, dimer acid, phthalic acid, isophthalic acid, terephthalic acid, isophthalic acid dimethyl ester, terephthalic acid dimethyl ester, terephthalic acid monomethyl ester, tetrahydroterephthalic acid, methyltetrahydrophthalic acid, hexahydrophthalic acid, dimethyltetrahydrophthalic acid, endomethylenehexahydrophthalic acid, naphthalenetetracarboxylic acid, diphenolic acid, trimellitic acid, pyromellitic acid, trimesic acid, cyclopentanedicarboxylic acid, 3,3'.4.4'-benzophenonetetracarboxylic acid, 1,2,3,4-butanetetracarboxylic acid, 2,2-bis(4-carboxyphenyl) propane, a diimidocarobxylic acid obtained from trimellitic anhydride and 4,4-diaminophenylmethane, tris-(β-carboxyethyl) isocyanurate, isocyanurate ring-containing polyimidocarboxylic acid, and isocyanate ring-containing polyimidocarboxylic acid obtained from the trimerization reaction product of tolylene diisocyanate, xylylene diisocyanate, or isophorone diisocyanate and trimellitic anhydride. They can be used singly or as a mixture of two or more kinds thereof. In these components, as the case may be, it is preferred to use a crosslinking component such as trihydric or higher polyhydric carboxylic acids, polyhydric alcohols, etc., in the point of the stability of the fixing strength, the offset resistance, etc.

The polyester resin obtained these raw materials is produced by an ordinary method. The glass transition temperature of the polyester resin used in this invention is preferably from 40 to 80° C., and more preferably from 50 to 70° C.

As the binder resin used in this invention, two or more kinds of the above-described polyester resins may be combined and further, the polyester resin may be combined with other resin. Examples of other resin which may be combined with the polyester resin include styrene resins, acrylic resins, styrene-acryl resins, silicone resins, epoxy resins, diene-based resins, phenol resins, terpene resins, coumalin resins, amide resins, amidoimide resins, butyral resins, urethane resins, and ethylene-vinyl acetate resins. In this invention, it is preferred that the polyester resin is the main constituent and other resin is added to the toner in an amount of from 0 to 30% by weight. Also, in the case of preparing the toner of this invention by dispersing a foaming agent in the binder resin and suspension polymerizing the mixture, the suspension-polymerizable monomer in the above-described monomers of the binder resins can be utilized.

Figure 2:
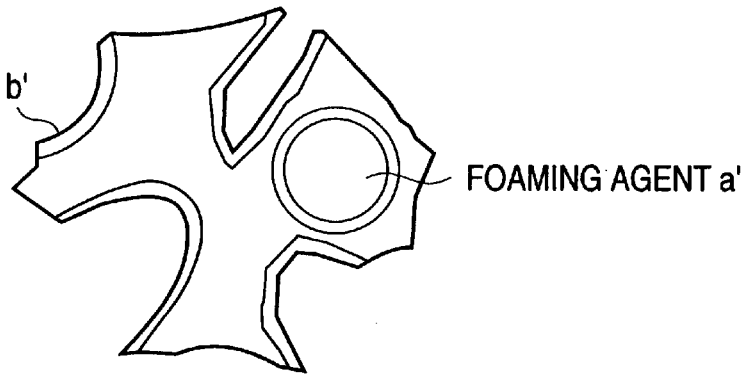
FIG. 2 is an enlarged schematic view of an embodiment of a cut piece of a related art three-dimensional image-forming toner.

An embodiment of the schematic enlarged view obtained by cut the toner particle of this invention and observing the cut piece by a microscope is shown in FIG. 1. Also, an embodiment of the schematic enlarged view obtained by cutting a toner particle for forming three-dimensional image produced by a conventional knead-grinding method is shown in FIG. 2. Toner A and toner A' are embodiments of using a microcapsule-type foaming agent as the foaming agent.

As shown as the enlarged view in FIG. 2, in the three-dimensional image-forming toner A' containing the foaming agent produced by a conventional knead-grinding method, the greater part of the foaming agent a' foams by heat during the production process of the toner and voids b' are formed. The foaming agent a' remained without foaming during the production process exposes to the surface of the toner, and further shells of the voids after foaming of the foaming agent a' exist at the surface of the toner, which causes to deteriorate the fixing property, etc. On the other hand, as shown in FIG. 1, in the toner particle of this invention, the foaming agent particles a are encapsulated in the core side of the toner. As described above, because the three-dimensional image-forming toner of this invention has the constitution that the foaming agents are not substantially exposed to the surface thereof, the toner has a high thermal expansibility and also keeps well the adhesive property to a recording medium and the charging stability.

In addition, the term "is not substantially exposed to the surface" in the specification shows that as the result of observing, for example, 50 toner particles by an electron microscope, the toners which are not exposed to the surface as shown in FIG. 1 are 80% or more. Also, as shown in FIG. 1, it is preferred that the foaming agents a are uniformly dispersed in the toner as particles because the adhesive property of the toner to a recording medium and the charging stability of the toner can be more improved.

If desired, the image-forming toner of this invention contains a coloring agent and may be visualized as a colored toner image. As a coloring agent dispersed in the toner, known organic or inorganic pigment or dye, or an oil-soluble dye can be used. Examples of the coloring agent include C.I. Pigment Red 48:1. C.I. Pigment Red 57:1, C.I. Pigment Red 122, C.I. Pigment Yellow 17, C.I. Pigment Yellow 97, C.I. Pigment Yellow 12, C.I. Pigment Blue 15:1, C.I. Pigment Blue 15:3, lamp black (C.I. No. 77266), Rose Bengal (C.I. No. 45432), carbon black, Nigrosinedye (C.I. No. 50415B), metal complexsaltdyes, the derivatives of metal complex salt dyes, and the mixtures of them. Furthermore, there are various metal oxides such as silica, aluminum oxide, magnetite, various kinds of ferrites, cupric oxide, nickel oxide, zinc oxide, zirconium oxide, titanium oxide, and magnesium oxide, and the proper mixture of these metal oxides. The addition amount of the coloring agent depends upon the particle size of the toner and the developing amount but is generally from about 1 to 100 parts by weight to 100 parts by weight of the toner.

Also, the image-forming toner of this invention may contain a magnetic substance to have a magnetization. As the magnetic substance, a known substance can be properly used. For example, metals such as iron, cobalt, nickel, etc., and the alloys of them; metal oxides such as $Fe_3O_4$, $\gamma$-$Fe_2O_3$, cobalt-containing iron oxide, etc.; and the magnetic substances formed from various kinds of ferrites such as MnZn ferrite, NiZn ferrite, etc., can be preferably used. In these magnetic substances $Fe_3O_4$ is particularly preferred and the particles of $Fe_3O_4$ having particle sizes of from 0.05 to 0.5 $\mu$m are used. It is preferred that these magnetic substances are treated with various treating agents at use for rendering hydrophobic. Furthermore, they can be used singly or a combination of two or more kinds of them. The content thereof can be, if necessary, properly selected according to the using purpose to the system but in the case of using as a magnetic toner, the content is preferably from 30 to 60% by weight.

The image-forming toner of this invention may contain, if desired, a releasing agent. By incorporating a releasing agent, the occurrence of the offset phenomenon, etc., at contact-fixing can be preferably prevented. There is no particular restriction on the releasing agent used and the following materials having a releasing property can be used. For example, there are low-molecular weight polyethylene, low-molecular weight polypropylene, vegetable waxes such as carnauba wax, cotton wax, Japan wax, rice wax, etc.,; animal waxes such as beeswax, lanolin, etc.; mineral waxes such as ozokerite, ceresin, etc.; and petroleum waxes such as paraffin, microcrystalline, petrolatum, etc. Also, in addition to these natural waxes, synthetic hydrocarbon waxes such as Fischer-Tropsch wax, polyethylene wax, etc., and synthetic waxes such as the fatty acid amide, esters, ketones, ethers, etc., such as 1,2-hydroxystearic acid amide, stearic acid amide, phthalic anhydride imide, chlorinated hydrocarbons, etc. can be used. Furthermore, as low-molecular weight crystalline high molecular resins, there are crystalline polymers having a long alkyl group at the side chain, such as the homopolymers or copolymers (for example, the copolymer of n-stearyl acrylate-ethyl methacrylate, etc.) of a polyacrylate such as poly n-stearyl methacrylate, poly n-lauryl methacrylate, etc.

It is preferred that the releasing agent is usually added as the fine particles thereof. Furthermore, it is preferred that the releasing agent is not exposed to the surface of the toner. When the releasing agent is exposed to the surface of the toner, the fluidity of the toner powder is lowered and the developing property of the toner, particularly, the keeping property if images is lowered. The mean particle size of the releasing agent may be properly determined according to the particle sizes of the toner prepared but is usually from 0.3 to 5 $\mu$m. The addition amount thereof depends upon the mean particle size of the releasing agent but is usually from 0.1 to 40% by weight, preferably from 1 to 15% by weight, and more preferably from 2 to 5% by weight. If the addition amount is lower than 0.1% by weight, the desired heat roll releasing property is insufficient and if the addition amount exceeds 40% by weight, the blocking resistance of the toner is lowered.

It is preferred to use the releasing agent as the fine powder thereof of from about 0.1 to 5 $\mu$m. The releasing agent can be fined by using each of the known methods using emulsification-dispersion instrument, etc., described in Hanno Kogaku Kenkyu Kai Report 1 "Emulsification-dispersion technique and particle size control of high molecular fine particles, Chapter 3" published by Koobunshi Gakkai, March 1995. Also, a method of using a proper solvent which is compatible with the solvent used at the preparation of the toner and does not dissolve the releasing agent a room temperature, after dissolving the releasing agent in the solvent by heating, gradually cooling the solution to room temperature to precipitate the fine particles of the releasing agent (dissolution precipitation method) can be also used. Furthermore, a method of evaporating the releasing agent by heating in an inert gas such as a helium gas, after preparing particles in a vapor phase, attaching the particles to a cooled film, etc., and recovering, and dispersing the recovered particles in a solvent (vapor-phase evaporation method) can be utilized. Also, by combining the method and a mechanical grinding method using a media, etc., the releasing agent can be more effectively fined.

If desired, the image-forming toner of this invention may contain a charge-controlling agent. As the charge-controlling agent which can be used in this invention, a compound selected from the group consisting of metal salts of benzoic acid, the metal salts of salicylic acid, metal salts of alkylsalicylic acid, metal salts of catechol, metal-containing bisazo dyes, tetraphenyl borate derivatives, quaternary ammonium salts, and alkylpyridinium salts, which have hitherto been used for powder toners, and a proper combination of them can be used.

The addition amount of the charge-controlling agent to the toner is in the range of generally from 0.1 to 10% by weight, and preferably from 0.5 to 8% by weight. If the addition amount is lower than 0.1% by weight, the charge-controlling effect is insufficient and if the addition amount exceeds 10% by weight, there sometimes occurs the problem that the toner resistance is excessively lowered and charging property becomes insufficient.

Moreover, together with the above-described charge-controlling agent, a metal soap or an inorganic or organic metal salt can be used. The metal soap used includes aluminum tristearate, aluminum distearate; the stearate of barium, calcium, lead, or zinc; the linolenate of cobalt, manganese, lead or zinc; the octanate of aluminum, calcium, or cobalt; the oleate of calcium or cobalt; zinc palmitate; the naphthenate of calcium, cobalt, manganese, lead, or zinc; the resin acid salt of calcium, cobalt, manganese, lead, or zinc; etc. Also, as the inorganic or organic metal salts, there are, for example, the salts that the cationic component in the metal salt is selected from the metals of group Ia, group IIa, and group IIIa of the periodic table and the anionic component of said salt is selected from halogens, carbonates, acetates, sulfates, borates, nitrates, and phosphate. The addition amount of the charge-controlling agent or the cleaning aid is in the range of generally from 0.1 to 10% by weight, and preferably from 0.1 to 5% by weight to the toner. If the addition amount is lower than 0.1% by weight, the desired effect is insufficient, and if the addition amount exceeds 10% by weight, the fluidity of the toner powder is sometimes lowered.

The image-forming toner of this invention may further contain a known external additive for controlling the fluidity and the developing property. As the external additive, various inorganic acid fine particles such as silica, alumina, titania, cerium oxide, etc., and, if necessary, hydrophobic fine particles, and also a vinylic polymer, zinc stearate, etc., can be used. It is preferred that the addition amount of the external additive is in the range of from 0.05 to 10% by weight to the amount of the toner before the addition thereof.

2. Preparation method of image-forming toner:

Then, the method of the preparation of the image-forming toner of this invention is explained.

First, an oil phase obtained by dissolving and/or dispersing the binder resin, the foaming agent and other additives, which are used if necessary, in an organic solvent is dispersed on an aqueous phase to prepare particles made of the oil phase.

For the preparation of the oil phase, a solvent which can dissolve at least the binder resin is used and the oil phase is prepared by dissolving the binder resin in the solvent and dissolving and dispersing the foaming agent and, if desired, other additives therein. The solvent which can be used depends upon the constituting components of the binder resin but generally includes hydrocarbons such as toluene, xylene, hexane, etc.; halogenated hydrocarbons such as methylene chloride, chloroform, dichloroethane, etc.; alcohols or ethers such as ethanol, butanol, benzyl alcohol, ether, tetrahydrofuran, etc.; esters such as methyl acetate, ethyl acetate, butyl acetate, isopropyl acetate, etc.; and ketones such as acetone, methyl ethyl ketone, diisobutyl ketone, cyclohexanone, methylcyclohexane, etc. These solvents are required to dissolve mainly the binder resin but may dissolve the foaming agent and other additives. The weight ratio of the toner component to the solvent in the oil phase is preferably from 10/90 to 80/20 in the points of the easiness of the granulation and the final toner yield.

Then, the oil phase prepared is dispersed in an aqueous phase such that desired particles are formed in the aqueous phase. In this case, the foaming agent is held in the inside of the particles made of the oil phase dispersed in the aqueous phase. As the result thereof, the toner wherein the foaming agent is not substantially exposed to the surface thereof can be easily produced. The aqueous phase used in this case is made of water as the main constituent and may be, if necessary, added with an inorganic or organic dispersion stabilizer forming a hydrophilic colloid. The inorganic dispersion stabilizer includes calcium carbonate, magnesium carbonate, barium carbonate, tri-calcium phosphate, hydroxy apatite, diatomaceous earth silicate, clay, etc. The particle size of the inorganic dispersion stabilizer is generally 2 $\mu$m or smaller, preferably 1 $\mu$m or smaller, and more preferably 0.1 $\mu$m or smaller. If the particle size of the inorganic dispersion stabilizer exceeds 2 $\mu$m, the particle size of the toner granulated becomes wide and for making the desired grain size distribution, a classification becomes necessary in a post step, which is undesirable from the view point of resource saving. For fining the particles of the inorganic dispersion stabilizer, a wet dispersing apparatus such as a ball mill, a sand mill, an attritor, etc., can be used.

The inorganic dispersion stabilizer may be used together with an organic dispersion stabilizer. Practical examples of the organic dispersion stabilizer include proteins such as gelatin, gelatin derivatives (e.g., acetylated gelatin, phthalate gelatin, succinated gelatin, etc.), albumin, casein, etc.; collodion, gumarabic, agaragar, alginic acid, cellulose derivatives (for example, the alkyl ester of carboxymethyl cellulose, hydroxymethyl cellulose, carboxymethyl cellulose, etc.), and synthetic polymers (for example, polyvinyl alcohol, polyvinyl pyrrolidone, polyacrylamide, polyacrylamide, polymethacrylamide, polymaleates, and polystyrenesulfonates), etc. These organic dispersion stabilizers may be used singly or as a mixture of two or more kinds of them. It is preferred to use the dispersion stabilizer in the range of from 0.001 to 5 parts by weight to the main medium of the aqueous phase.

For the aqueous phase, a dispersion stabilizer aid may be used together. As the dispersion stabilizer aid, various surface active agents can be used. As the surface active agents, anionic or nonionic surface active agents can be used. Practically, as anionic surface active agents, alkylbenzene sulfonates, alkylphenyl sulfonates, alkylnaphthalene sulfonates, higher fatty acid salts, the sulfuric acid ester salts of higher fatty acid esters, the sulfonates of higher fatty acid esters, etc., can be used. As cationic surface active agents, primary to tertiary amine salts, quaternary Fammonium salts, etc., can be used. As nonionic surface active agents, polyoxyethylene nonylphenyl ether, polyoxyethylene octylphenyl ether, polyoxyethylene dodecylphenyl ether, polyoxyethylene alkyl ether, polyoxyethylene fatty acid ester, sorbitan fatty acid ester, polyoxyethylene sorbitan fatty acid ester, fatty acid alkylolamide, etc., can be used.

These dispersion stabilizer aids may be used singly or as a mixture of two or more kinds of them. It is preferred to use the dispersion stabilizer aid in the range of from 0.001 to 5 parts by weight to the main medium of the aqueous phase.

The mixing ratio of the oil phase to the aqueous phase differs according to the particle sizes of the final toner and the production apparatus of the toner but is preferably from 10/90 to 90/10 by weight ratio. The granulation of the oil phase in the aqueous phase is preferably carried out under a high-speed shear. In particular, it is preferred to use a high-speed blade rotation type or forcibly interval passing type emulsifier such as various homomixers, homogenizers, colloid mills, etc.

Simultaneously with or after the granulation of the oil phase in the aqueous phase, the solvent is removed. The removal of the solvent may be carried out at normal pressure or at a reduced pressure. In the case of carrying out at a normal pressure, it is necessary that the temperature of the solvent removal is lower than the boiling point of the solvent and is set to a temperature of considering the glass transition temperature (hereinafter, is referred to as "Tg") of the resin. When the solvent removal is carried out at a temperature exceeding Tg, uniting of the toners each other undesirably occurs. It is preferred to carry out the removal of the solvent with stirring at about 40° C. for from 3 to 24 hours. In the case of carrying out the solvent removal, it is preferred to carry out the solvent removal at a pressure of from 20 to 150 mm Hg.

After removing the solvent, if desired, the toner obtained may be washed. It is preferred that washing is carried out with an acid capable of dissolving the inorganic dispersion stabilizer, etc., attached to the surface of the toner, such as hydrochloric acid, nitric acid, formic acid, acetic acid, etc.

When the inorganic dispersion stabilizer and the organic dispersion stabilizer remain on the surface of the toner, it sometimes happens that the temperature reliance of the charging property as the toner becomes high owing to the hygroscopic property of the remaining attached materials. Accordingly, it is preferred to wash out the dispersion stabilizers because the charging stability of the toner is more improved. After washing the toner with the acid, if desired, the toner may be washed again with an aqueous alkali solution such as an aqueous sodium hydroxide solution, etc., whereby a part of ionic substances of the surface of the toner, which are insolubilized by being placed under an acidic atmosphere, are solubilized again and removed, and the charging property and the fluidity of powder are more improved.

Washing can be efficiently carried out by controlling the conditions such as the pH at washing, the number washing times, the temperature at washing, etc. Furthermore, it is preferred to use a stirrer, a ultrasonic dispersing apparatus, etc., because in this case, the washing operation can be more effectively carried out. After washing the toner, if desired, the processes such as a filtration, a decantation, a centrifugal separation, etc., is carried out and then the toner is dried.

Because in the preparation method of the toner of this embodiment, in each of the steps, a treatment of carrying out under heating at high temperature is not contained, the thermal expansibility of the foaming agent is not deactivated in the preparation processes and the toner obtained has a high thermal expansibility.

As other method of preparing the toner of this invention, there is a method of utilizing a suspension polymerization.

That is, the foaming agent and, if desired, other additives are dissolved or dispersed in the monomer of the binder resin. The monomer of the binder resin is suspension-dispersed in an aqueous phase. In this case, the foaming agent is held in the inside of the particles made of the monomer dispersed in the aqueous phase. Then, when an optional initiator is added to the aqueous phase and the monomer is suspension-polymerized, a polymerization proceeds in the inside of the monomer particles while containing the foaming agent in the inside thereof. As the result thereof, the particles wherein the foaming agent is not substantially exposed to the surface thereof are efficiently and easily produced. The progress of the suspension polymerization differs according to the kind of the monomer but the suspension polymerization generally proceeds in the temperature range of from 60° C. to 90° C. As described above, as compared with the case of preparing by a conventional knead-grinding method, in the suspension-polymerization method of this invention, the preparation process can be proceeded at a low temperature, whereby the thermal expansibility of the foaming agent can be restrained from being deactivated during the preparation process. Accordingly, the toner obtained by the suspension-polymerization method has a high thermal expansibility.

In addition, other additives may be dispersed in the aqueous phase in place of previously dispersing in the monomer. Also, the initiator may be previously dissolved or dispersed in the monomer.

After finishing the suspension polymerization, the toner obtained may be subjected to a washing treatment and a drying treatment. The practical operation of each treatment is same as described above.

According to the preparation method of the toner of this invention, the form of the toner obtained can be controlled to a spherical form to an indefinite form, or to a form having fine unevenness on the surface thereof, or to a form having creases, holes, or projections on the surface by controlling the formulation of the toner materials and the condition of the process of removing the solvent from the toner after granulation. Practically, the form of the toner can be controlled in the range that the shape factor MLS2 shown by the following equation (1) is from 100 to 160. Incidentally, the form of toners prepared by a conventional knead-grinding method is amorphous, and their MLS2 is about 140 to 160.

$$MLS2=(A)^2/(B)\times\pi\times\tfrac{1}{4}\times 100 \quad (1)$$

(A): The absolute longest length of toner particles (B): Projected area of toner particle 3. Forming method of three-dimensional image and image-forming apparatus:

By using the image-forming toner of this invention, using the fixing apparatus of an electrophotographic image-forming apparatus such as a general copying machine, printer, etc., a three-dimensional image can be formed by fixing the toner image to a recording medium and at the same time foaming the foaming agent in the toner. As the fixing apparatus, a fixing apparatus of a conventional heating system, such as, an open system, a heat roll system, a heat belt system, etc., can be properly used but in these systems, the fixing apparatus of a heat roll system, which is most widely applied to an electrophotographic system at present, is preferably used. As described above, by using the image-forming toner of this invention, a three-dimensional image can be easily formed using the apparatus utilizing a general electrophotographic system without newly designing an image-forming apparatus for forming a three-dimensional image and without applying a substantial modification. Also, because many sheets having three-dimensional images can be easily copied by the easiness as copying in an office, a book, etc., containing Braille types and/or three-dimensional images can be easily prepared.

By foaming the image-forming toner of this invention, the fixing temperature is established to a temperature of from 140° C. to 250° C., preferably from 160° C. to 250° C., and more preferably from 180° C. to 250° C. If the fixing temperature is lower than 140° C., the foaming agent does not sometimes sufficiently foam and thus an image having a sufficient thickness is not sometimes obtained. On the other hand, when the fixing temperature exceeds 250° C., it sometimes happens that the binder resin, etc., is decomposed and the decomposition products give a problem of environmental safety.

In addition, it is not always necessary to simultaneously carry out the fixing and the foaming of the foaming agent and after one fixing images by a fixing roll, etc., of a relatively low temperature, the foaming agent may let foam separately by the fixing roll of a relatively high temperature of the above-described temperature range.

Also, by using the toner of this invention, by only adding a means of controlling the fixing temperature to a conventional electrophotographic image-forming apparatus, an image-forming apparatus capable of forming both ordinary images (plane images) and three-dimensional images is obtained. As the means of controlling the fixing temperature, for example, there is a control system of controlling a heater contained in the fixing roll according to the input of information from a user and setting a temperature $T_1$° C. higher than the established temperature $T_0$° C. of the fixing roll in an ordinary image-forming mode. In this case, the fixing temperature $T_1$° C. is a sufficiently high temperature for foaming the foaming agent contained in the toner at the established fixing speed.

Also, because the foaming initiation of the foaming agent depends not only on the fixing temperature but also on the fixing speed, by adding a means of controlling the fixing speed to a conventional image-forming apparatus, an image-forming apparatus capable of forming both plane images and three-dimensional images can be obtained. As the means for controlling the fixing speed, there is a system of controlling the rotating speed of the fixing roll according to the input of information from the user and setting the speed of a recording medium having unfixed images passing through a nip portion to a speed $v_1$ higher than an ordinary speed $v_0$. The speed $v_1$ is a sufficient speed for foaming the foaming agent in the toner in the case of passing the recording medium passing through a nip portion at the speed of $v_1$ at the established temperature of the fixing roll.

The toner obtained by the production method of this invention can be used for a known dry electrostatic charge developing method without restriction. For example, the toner of this invention can be used for an image-forming apparatus of employing, for example, a two-component developing method such as a cascade method, a magnetic brash method, a microtoning method, etc.; a one-component method such as an electrically conductive one-component developing method, an insulating one-component developing method, etc.; or further a non-magnetic one-component developing method, etc. Furthermore, a unique process effectively utilizing the low toner attaching force caused by the above-described spherical toner form can be designed. About the point that the shape factor MLS2 exceeds 140, lowering of the transfer efficiency of the toner is seen and thus in order to increase the toner efficiency, it is desirable that the MLS2 is from about 100 to 120. A small-sized and simple process utilizing the high transfer efficiency characteristics of toner and employing a cleaning member-less system can be also designed and the toner of this invention is suitable for use in such processes.

Figure 3:
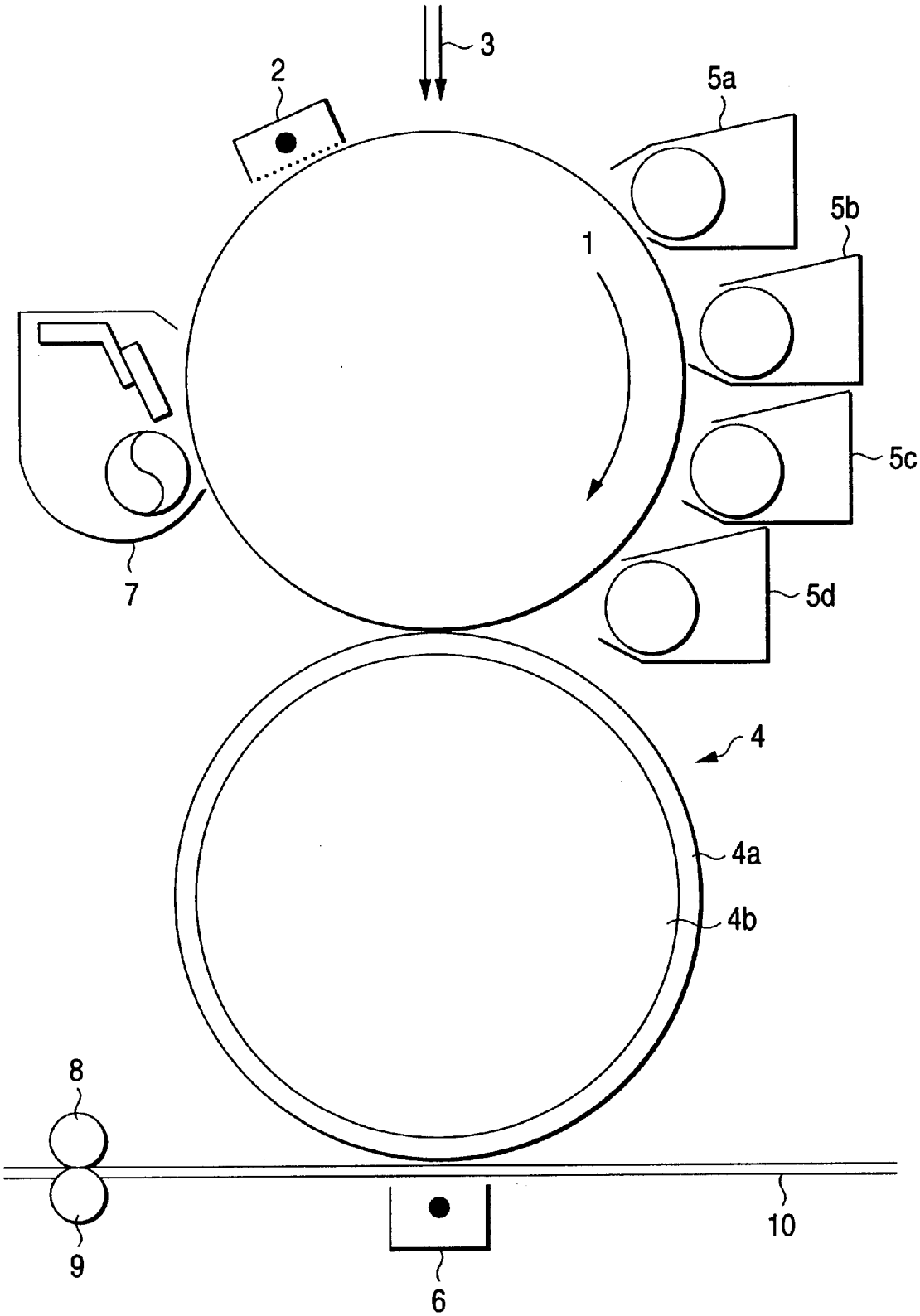
FIG. 3 is a schematic cross-sectional view showing an embodiment of an image-forming apparatus utilized for an image-forming method using the image-forming toner of this invention.

FIG. 3 is an embodiment of a process of forming full-color images using the toners of this invention but the process using the toners of this invention is not limited to the process. A photoreceptor 1 is a photosensitive drum or belt having a photoconductive insulating layer such as a-Se, OPC, a-Si, ZnO, etc. In these substances, the OPC or a-Si photoreceptor is preferably used. The photoreceptor 1 is uniformed charged by a corona discharging means 2. Charging of the photoreceptor 1 may be carried out using a contact-type discharging apparatus using a roller or a magnetic brush in place of such a non-contact-type discharging apparatus.

The photoreceptor 1 is imagewise exposed (3) by an exposing apparatus (not shown) and an electrostatic latent image is formed on the photoreceptor 1. The electrostatic latent image is developed with each developer at the position facing each of developing apparatus 5*a* to 5*d*. In the case of a full-color copying machine, the developing apparatus 5*a* to 5*d* contain cyan, magenta, yellow, and black developers respectively. Each of the developers contained in the developing apparatus 5*a* to 5*d* may be the developer made of the toner of this invention as the main constituent. Or, by adding a means for controlling the developing apparatus of 5*a* to 5*d*, a system capable of selecting the developing apparatus containing the toner of this invention according to the input of the user, etc., is incorporated, and a three-dimensional image may be selectively formed. The developing apparatus 5*a* to 5*d* may be a magnetic brush developing system or a non-magnetic one-component developing system. Because in the toner of this invention, the foaming agent is not substantially exposed to the surface thereof, the charging stability of the toner is high and good developing characteristics can be obtained using a conventional developing apparatus.

Each toner image of each color formed on the photoreceptor 1 is successively transferred onto an intermediate transfer material 4. The intermediate transfer material 4 is composed of a pipe-form electrically conductive core metal 4*b* having formed on the surface an elastic layer 4*a* having a controlled electric resistant value. The toner image on the intermediate transfer material is applied with a bias of the opposite polarity to that of the friction charge of the toner by a transfer means 6 and is transferred onto the surface of a recording medium 10. Thereafter, the photoreceptor 1 returns to the initial state through a cleaning step by a detachable cleaning means 7.

The toner image transferred onto the recording medium is passed through a nip portion between a heating roll 8 containing a heater such as a halogen heater and a press roll 9 of an elastic material which is in press-contact with the heating roll 8 by a pressing force, whereby the toner image is fixed to the recording medium and also the foaming agent contained in the toner foams to form a three-dimensional image. The three-dimensional image obtained by the process using the toner of this invention has a sufficiently recognizable thickness of image and also the adhesive property of the toner image to the recording medium such as paper is high.

Figure 4:
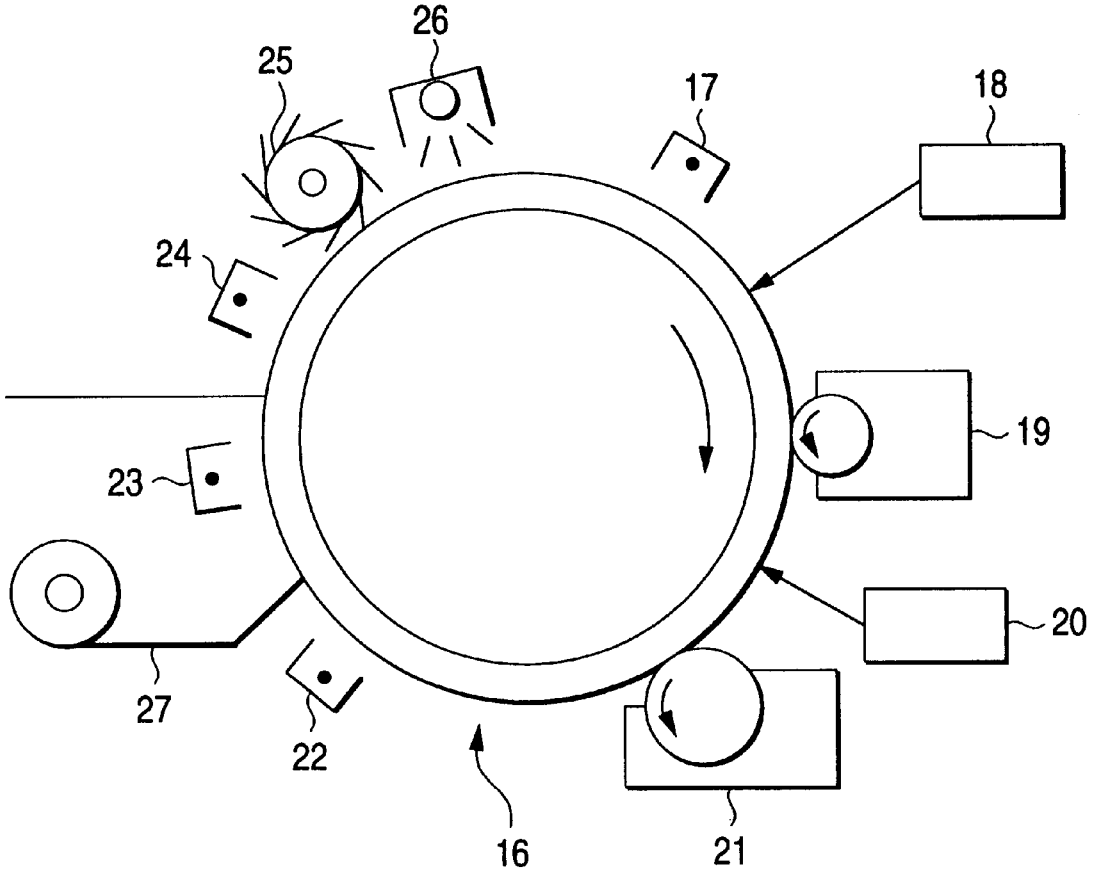
FIG. 4 is a schematic cross-sectional view showing other embodiment of an image-forming apparatus utilized for an image-forming method using the image-forming toner of this invention.

The image-forming toner of this invention can easily form both three-dimensional images and ordinary images by using a simultaneous two-color copying machine, for example, shown in FIG. 4.

The simultaneous two-color copying machine has a 1st developing means 19 and a 2nd developing means 21. The 1st developing means 19 contains a developer containing the toner of this invention and the 2nd developing means 21 contains an ordinary image-forming toner. When a manuscript is read in, the images to be output as three-dimensional images and the images to be output as ordinary images are distinguished (for example, distinguish by recognizing the colors of the images of the manuscript). On the other hand, a photoreceptor drum 16 is uniformly charged by a discharging apparatus 17. Thereafter, the photoreceptor drum 16 is imagewise exposed by a 1st exposing apparatus 18 according to the selected image signal (for three-dimensional images) and an electrostatic latent image (for three-dimensional image) is formed on the photoreceptor drum 16. The electrostatic latent image for three-dimensional image is developed with the toner of this invention at the position facing the 1st developing means 19.

Then, according to the selected image signal (for ordinary images), the photoreceptor drum 16 is further imagewise exposed by the 2nd exposing apparatus 20 and an electrostatic latent image (for ordinary images) is formed on the photoreceptor drum 16. The electrostatic latent image for ordinary image is developed with an ordinary toner at the position facing the 2nd developing apparatus 21. Thereafter, the toner images formed on the photoreceptor drum 16 are transferred onto a recording paper by a before-transfer discharging apparatus 22 and a transfer discharging apparatus 23 and thereafter, the recording paper is passed through a nip portion of a heating roll, etc., whereby the fixed images are formed on the recording paper. When the transferred toner images are heated by the heating roll, etc., at fixing, the foaming agent in the toner of this invention foams, the image at a definite position becomes a three-dimensional image, and both the three-dimensional image and the ordinary image are formed on the recording paper.

The, the invention is explained practically by the following examples and comparative examples but the invention is not limited to the examples and the comparative examples.

EXAMPLE 1

(A) Preparation of pigment dispersion 1:

A pigment dispersion 1 was prepared by the following process.

| | | |
|---|---|---|
| 1. | Carbon black: ("No. 25", made by Mitsubishi Chemical Corporation) | 20 parts by weight |
| 2. | Dispersing agent: ("DA-703-50", made by Kusumoto Kasei K. K. removing the solvent) | 4 parts by weight |
| 3. | Ethyl acetate: | 76 parts by weight |

To the dispersion of the above-described composition were added glass beads and the mixture was placed in a dispersion vessel of a sand mill dispersing machine. While cooling the circumference of the dispersion vessel, the mixture was dispersed for 3 hours at a high-speed stirring mode to prepare a pigment dispersion 1 having a pigment concentration of 20% by weight.

(B) Preparation of Oil phase 1:

An oil phase 1 was prepared by the following process.

| | | |
|---|---|---|
| 1. | Polyester resin A: (Composition: bisphenol A-ethylene oxide adduct/bisphenol A-propylene oxide adduct/terephthalic acid-based condensate, Tg: 62° C., softening point: 102° C., eight average molecular weight: 9300) | 115 parts by weight |
| 2. | Pigment dispersion 1: (pigment concentration 20% by weight) | 8.3 parts by weight |
| 3. | Foaming agent: ("Expancel 091", made by Expancel Co., microcapsules using isobutane as the core and a copolymer of vinylidene chloride and acrylonitrile as the shell material) | 20.6 parts by weight |
| 4. | Ethyl acetate: | 131 parts by weight |

An oil phase of the above composition was placed in homomixer ("Ace Homogenizer", made by NIPPON SEIKI Co., Ltd.) and stirred for 2 minutes at 15000 r.p.m. to prepare a uniform oil phase 1.

(C) Preparation of aqueous phase 1:

An aqueous phase 1 was prepared by the following process.

| | | |
|---|---|---|
| 1. | Aqueous solution of 40% by weight calcium carbonate: ("Luminas", made by Maruo Calcium K. K.) | 25 parts by weight |
| 2. | Aqueous solution of 2% by weight carboxymethyl cellulose Na: ("Celogen BS-H", made by DAI-ICHI KOGYO SEIYAKU CO., LTD.) | 75 parts by weight |
| 3. | Pure water: | 160 parts by weight |

The components described above were placed in a ball mill and stirred for 4 days to prepare an aqueous phase 1.

(D) Production method of toner 1:

1. The oil phase 1: 200 parts by weight
2. The aqueous phase 1: 248 parts by weight The above-described components were placed in a Ultra Tax (made by IKA Co.) and emulsified at a temperature of 15° C. for one minute at 10,000 r.p.m. to obtain an emulsion. The emulsion was placed in a rotary evaporator and the solvents were removed at room temperature for 3 hours at a reduced pressure of 30 mm Hg. Thereafter, an aqueous solution of 12N hydrochloric acid was added to the residue until the pH became 2 and calcium carbonate was removed from the surface of the toner. Then, an aqueous solution of 10N sodium hydroxide was added thereto until the pH became 10 and further the mixture was stirred by a stirrer in a ultrasonic washing bath for one hour. Furthermore, a centrifugal precipitation was carried out, and after washing by exchanging the supernatant three times followed by drying, about 100 g of the toner 1 was obtained. By repeating the same process three times, about 500 g of the toner 1 was prepared. The volume average particle size D50 of the toner 1 was 30.2 $\mu$m and GSD, which was a particle distribution index, was 1.42.

(E) Preparation of developer 1:

To the toner 1 prepared in (D) were added rutile type titanium oxide $TiO_2$ having a mean particle size of 15 nm subjected to a hydrophobic treatment with decyltrimethoxysilane and silica $SiO_2$ having a mean particle size of 50 nm subjected to an HMDS treatment as 0.35% by weight and 0.2% by weight respectively as external additives, and the mixture was mixed using a Henschel mixer. A carrier was prepared by coating a ferrite carrier core of 100 $\mu$m (made by Powder Tec Co.) with 0.25 part by weight of an acrylic resin having a fluorine-containing group and an amino group and mixed with the toner 1 such that the weight concentration of the toner became 23% by weight to prepare a developer 1.

(F) Evaluation by practical machine:

As the evaluation apparatus of the image output, a color copying machine "A Color 935" (made by FUJI XEROX CO., LTD.) was used. The scheme of the image output evaluation apparatus is shown in FIG. 3. As a black developer of the black developing apparatus, about 600 g of the developer 1 was placed therein and as a supplying toner, about 100 g of the toner 1 added with the same external additives was further added. The mode of the copying machine was set to an OHP mode contained therein. In the mode, the process speed became from ordinary 160 mm/second to 80 mm/second. As a manuscript, images containing Braille types and a map were used and output to a plain paper. As the result thereof, a good black three-dimensional image was output, the image height was about 200 $\mu$m, and the image could be sufficiently recognized as a Braille type. The fixing property was sufficient for practical use and the three-dimensional image showed a sufficient strength and a high adhesive property with the paper. Also, the continuous image output was carried out onto about 3000 papers but there occurred no deviation of the image density, no deviation of the image height, and no lowering of the image quality, and the image output was stable.

EXAMPLE 2

(A) Preparation of pigment dispersion 2:

The pigment dispersion was prepared by the following process.

| | | |
|---|---|---|
| 1. | Magnetic substance: ("BL220", made by Titan Kogyo K. K.) | 50 parts by weight |
| 2. | Dispersing agent: ("DA-705"; made by Kusumoto Kasei K. K., removed the solvent) | 4 parts by weight |
| 3. | Ethyl acetate: | 46 parts by weight |

To the dispersion of the above-described composition were added glass beads and the mixture was placed in a dispersion vessel of a sand mill dispersing machine. While cooling the circumference of the dispersion vessel, the mixture was dispersed by a high-speed stirring mode for 3 hours to prepare a pigment dispersion 2 having a pigment concentration of 50% by weight.

(B) Preparation of fine-granulated wax dispersion 1:

A finely granulated wax dispersion 1 was prepared by the following process.

| | | |
|---|---|---|
| 1. | Paraffin wax: (melting point: 85° C., melt latent heat: 193 mJ/mg) | 15 parts by weight |
| 2. | Ethyl acetate: | 85 parts by weight |

The above-described components were placed in a dispersing machine equipped with stirring vanes and having a function of circulating a heat medium the circumference of the vessel. While stirring the mixture at 83 r.p.m., the temperature was gradually raised and the mixture was stirred for 3hours at about 80° C. Then, while stirring, the temperature was lowered to room temperature at a rate of about 2° C./minute to precipitate finely granulated wax. When the mean particle size was measured using a laser diffraction/scattered particle size distribution measurement apparatus "LA-700" made by HORIBA, LTD., the mean particle size was about 1.02 μm. The wax dispersion was dispersed again using a high-pressure emulsifier "APV GAULIN HOMOGENIZER TYPE 15MR" at a pressure of 500 kg/cm$^2$. When the particle size of the granulated wax was similarly measured, the particle size was 0.6 μm. The dispersion of the finely granulated wax prepared was diluted with ethyl acetate such that the weight concentration of the wax became 15% by weight to obtained a fine-grain wax dispersion 1.

(C) Preparation of oil phase 2:

An oil phase 2 was prepared by the following process.

| | | |
|---|---|---|
| 1. | Polystyrene-acryl resin B: (composition: styrene-n-butyl acrylate copolymer (70:30), Tg: 60° C., weight average molecular weight 38000) | 88 parts by weight |
| 2. | The pigment dispersion 2: (pigment concentration 50% by weight) | 30 parts by weight |
| 3. | Foaming agent: ("Expancel 051", made by Expancel Co., microcapsules using isobutane as the core material and a copolymer of vinylidene chloride and acrylonitrile as the shell material) | 20.6 parts by weight |
| 4. | Charge-controlling agent: ("Bontron E84", made by Orient Kagaku K. K.) | 2 parts by weight |
| 5. | The fine-particle wax dispersion 1: | 30 parts by weight |
| 6. | Ethyl acetate: | 90 parts by weight |

The above-described components were placed in a homomixer ("Ace Homogenizer", made by NIPPON SEIKI CO., LTD.) and stirred for 2 minutes at 15,000 r.p.m. to prepare a uniform oil phase 2.

(D) Preparation of aqueous phase 2:

An aqueous phase 2 was prepared by the following process.

The components described above were placed in a ball mill

| | | |
|---|---|---|
| 1. | Aqueous solution of 40% by weight calcium carbonate: ("Luminas", made by Maruo Calcium K. K.) | 25 parts by weight |

-continued

| | | |
|---|---|---|
| 2. | Aqueous solution of 2% by weight carboxymethyl cellulose Na: ("Celogen BS-H", made by DAI-ICHI KOGYO SEIYAKU CO., LTD.) | 75 parts by weight |
| 3. | Pure water: | 160 parts by weight |

and stirred for 4 days to prepare an aqueous phase 2.

(E) Production method of toner 2:

1. The oil phase 2: 200 parts by weight
2. The aqueous phase 2: 248 parts by weight The above-described components were placed in a Ultra Tax (made by Tokushu Kiki K.K.) and emulsified at a temperature of 15° C. for one minute at 10,000 r.p.m. to obtain an emulsion. Then, the emulsion was placed in a rotary evaporator and the solvents were removed at room temperature for 3 hours at a reduced pressure of 30 mm Hg. Thereafter, an aqueous solution of 12N hydrochloric acid was added to the residue until the pH became 2 and calcium carbonate was removed from the surface of the toner. Then, an aqueous solution of 10N sodium hydroxide was added thereto until the pH became 10 and further the mixture was stirred by a stirrer in a ultrasonic washing bath for one hour. Furthermore, a centrifugal precipitation was carried out, and after washing by exchanging the supernatant three times followed by drying, about 100 g of the toner 1 was obtained. By repeating the same process, about 500 g of the toner was prepared. The toner was named to be a toner 2. The volume average particle size D50 of the toner 2 was 32 μm and the particle distribution index GSD was 1.5.

(F) Preparation of developer 2:

To the toner 2 prepared in (E) was added 0.25% by weight silica $SiO_2$ having a mean particle size of 12 nm subjected to a dimethyl silicon oil treatment and the mixture was mixed using a Henschel mixer to obtain a magnetic one-component developer, which was named to be a developer 2.

(G) Evaluation by practical machine:

As the evaluation apparatus of the image output, "XP-15" (made by FUJI XEROX CO., LTD.) LBP was used. The established temperature of the fixing device of the apparatus was established to be about 30° C. higher. As a manuscript, images containing Braille types and a map were used and output to a plain paper. As the result thereof, a good black image was output, the image height was about 180 μm, and the image could be sufficiently recognized as a Braille type. The fixing property was sufficient for practical use and the three-dimensional image showed a sufficient strength and a high adhesive property with the paper. Also, the continuous image output was carried out onto about 2000 papers but there occurred no deviation of the image density, no deviation of the image height, and no lowering of the image quality, and the image output was stable.

EXAMPLE 3

(A) Preparation of toner 3:

By following the same procedure as Example 1 except that 2 parts by weight of a charge-controlling agent ("Bontron E81"; made by Orient Kagaku K.K.) was added to the oil phase 1 of Example 1, a toner was prepared. The toner was named to be a toner 3. The volume average diameter D50 of the toner 3 was 28.5 μm and the particle size distribution index GSD was 1.38.

(B) Preparation of developer 3:

To the toner 3 were added 0.27% by weight silica having a mean particle size of 12 nm subjected to a dimethyl silicone oil treatment and 0.33% by weight rutile type titanium oxide having a mean particle size of 15 nm subjected to a hydrophobic treatment with decylmethoxy silane and the mixture was mixed by a Henschel mixer to prepare a non-magnetic one-component developer. The developer was named to be a developer 3.

(C) Evaluation by practical machine:

As the image output evaluation apparatus, "XP-15" (made by FUJI XEROX CO., LTD.) LBP was used as in Example 2 and the established temperature of the fixing device of the apparatus was about 25° C. increased. Also, the developing apparatus thereof was changed to a non-magnetic one-component developing machine. As a manuscript, images containing Braille styles and a map were used and output to a plain paper. As the result thereof, a good black image was output, the image height was about 180 μm, and the image could be sufficiently recognized as a Braille type. The fixing property was sufficient for practical use and the three-dimensional image showed a sufficient strength and a high adhesive property with the paper. Also, the continuous image output was carried out onto about 2000 papers but there occurred no deviation of the image density, no deviation of the image height, and no lowering of the image quality, and the image output was stable.

EXAMPLE 4

(A) Preparation of toner 4 and preparation of developer 4:

By following the same procedure as Example 1 except that the pigment dispersion was not added, a toner was prepared. The toner was named to be a toner 4. The toner was a colorless toner, the volume average diameter D50 of the toner 4 was 29 μm and the particle size distribution index GSD was 1.35. Then. by the same manner as Example 1, a developer was prepared. The developer was named to be a developer 4.

(B) Evaluation by practical machine:

Using the same image-forming apparatus as Example 1 and also using the developer 4, a three-dimensional image was formed. In this case, ordinary color developers (cyan, magenta, and yellow developers each containing no foaming agent) were placed the developing apparatus respectively. As a manuscript, an ordinary color image was used and in the image, the image portion which was intended to be copied as a Braille type and a convex image were shown by black color. In the output image, the image portion which was intended to be copied as a Braille type and a convex image became colorless three-dimensional images and the color image portions were formed as ordinary plane images. Thus, the images which could be seen usually by an ordinary person and could be recognized by a blond person by stroking could be simultaneously formed. As the result of evaluating the three-dimensional image portion as in Example 1, the three-dimensional image was sufficient for practical use.

EXAMPLE 5

In a 2 liter four neck flask equipped with a high-speed stirring apparatus "TK Homomixer", an aqueous dispersion medium containing 710 parts by weight of ion-exchanged water and 60 parts by weight $CaCO_3$ ("Luminas", made by Maruo Calcium K.K.) was prepared. Apart from this, a dispersoid having the following composition was prepared.

| | |
|---|---|
| Styrene monomer: | 165 parts by weight |
| n-Butyl acrylate monomer: | 35 parts by weight |
| Pigment: ("Cyanine Blue 4933M", made by Dainichiseika Color & Chemical Mfg. Co., Ltd.) | 14 parts by weight |
| Foaming agent: ("Expancel Pastran 091", made by Expancel Co., microcapsule using isobutane as the core material and the co-polymer of vinylidene chloride and acrylonitrile as the shell material) | 40 parts by weight |
| Charge-controlling agent: ("Bontron E81", made by Orient Kagaku K. K.) | 2 parts by weight |
| Paraffin Wax (melting point: 85° C.) | 10 parts by weight |

After dispersing the mixture of the above-described composition for 3 hours using an attriter, 10 parts by weight of 2,2'-azobis(2,4-dimethylvaleronitrile) as apolymerization initiator to provide a polymerizable monomer composition and the composition was added to an aqueous dispersoid. The mixture was stirred at 80° C. for 8 hours. After the polymerization was finished, the slurry formed was cooled, diluted hydrochloric acid was added to the slurry to remove the dispersion stabilizer, after drying, the residue formed was classified to obtain a toner having the volume average diameter D50 of 35 μm and the particle size distribution GSD of 1.4 was obtained. Then, by the procedure as in Example 1, a developer 5 was prepared and the same evaluation as above was carried out. As the result, the toner showed a sufficient performance for practical use.

COMPARATIVE EXAMPLE 1

By following the same procedure as Example 1 except that the foaming agent was not added, toner particles were prepared. The toner was named to be a toner 6. The volume mean particle size D50 of the toner 6 was 28.3 μm and the particle side distribution index GSD was 1.35. After adding thereto the external additives used in Example 1 as external additives and further 20% by weight the above-described foaming agent "Expancel 091" (made by Expancel Co.), by further following the same procedure as in Example 1, a developer 6 was prepared.

Using the developer 6 obtained, an image was formed using the same image-forming apparatus as used in Example 1. The image obtained was inferior in the fixing property to a plain paper and the developing property, and thus there was a problem for practical use.

COMPARATIVE EXAMPLE 2

| | | |
|---|---|---|
| 1. | Polyester resin A: (Tg: 62° C., softening point: 102° C., weight average molecular weight: 9300) | 115 parts by weight |
| 2. | Carbon black: ("No. 25", made by Mitsubishi Chemical Corporation) | 1.6 parts by weight |
| 3. | Foaming agent ("Expancel 091", made by Expancel Co.; microcapsule using isobutane as the core material and copolymer or vinylidene chloride and acrylonitrile as the shell material) | 20.6 parts by weight |

The above-described components were powder-mixed by a Henschel mixer and the mixture was heat-kneaded by an extruder of a screw rotation number of 200 r.p.m. at 140° C. In this case, the outlet temperature was 190° C. After cooling, the kneaded mixture was roughly ground and further finely ground. Thereafter, by classifying the ground mixture, a finely ground product having the volume mean particle size D50 of 25.5 μm was obtained. The ground product was further classified to obtain a toner having the volume mean particle size D50 of 28.0 μm and the particle size distribution index GSD of 1.36. The toner was named to be a toner 7. Furthermore, by following the same procedure as in Example 1 using the toner 7, a developer 7 was prepared.

Using the developer 7 obtained, an image was formed using the same image-forming apparatus as in Example 1. The thickness of the image obtained was insufficient. Also, the image was inferior in the fixing property to a plain paper and the developing property, and there was a problem for practical use.

EXAMPLE 6

(A) Preparation of toner 8 and preparation of developer 8:

By following the same procedure as Example 1 except that in the preparation of the oil phase 1 of Example 1, the polystyrene-acryl resin B used for the preparation of the oil phase 2 of Example 2 was used in place of the polyester resin A, "Expancel 461" (made by Expancel Co.) was used in place of "Expancel 091" as a foaming agent, and further, 1.5 parts by weight of "Bontron P51" (made by Orient Kagaku K.K.) was used as a charge-controlling agent, a toner was prepared. The toner obtained was named to be a toner 8. The volume mean particle size D50 of the toner 8 was 30.5 μm and the particle size distribution index GSD was 1.45. To the toner 8 was added 0.75% by weight of rutile type titanium oxide having a mean particle size of 15 nm subjected to a decyltrimethoxysilane treatment as an external additive and then the mixture was mixed using a Henschel mixer.

Apart from this, a carrier was prepared by coating 100 parts by weight of a ferrite carrier core of 100 μm (made by Powder Tec Co.) with 0.6 part by weight vinylidene fluoride resin/acrylic resin by a kneader. The carrier was mixed with the above-described toner 8 such that the toner weight concentration became 15% by weight to obtained a developer 8.

(B) Evaluation by practical machine:

As an image output apparatus, a copying machine, "Vivace 500" (made by FUJI XEROX CO., LTD.) was used. In place of a color developer contained in the monochromatic color developing apparatus of the copying machine, about 360 g of the above-described developer 8 was placed. Also, as the supplemental toner, about 50 g of the toner 8 added with the external additive was placed. The established temperature of the fixing apparatus of the copying machine was 20° C. raised over an ordinary temperature. As a manuscript, an image containing a Braille type and a map was used and output to a plain paper. The image obtained was a convex three-dimensional image. When the image was evaluated as in Example 1, it was confirmed that the image had a sufficient image thickness and the fixing property, etc., for practical use.

In addition, in the case of copying an ordinary image, the system may be exchanged to a black development mode, and thus, by one copying machine, an ordinary image and a three-dimensional image could be easily selectively formed.

EXAMPLE 7

(A) Preparation of toner 9 and preparation of developer 9:

By following the same procedure as Example 1 except that in the preparation of the oil phase 1 of Example 1, the foaming agent "Expancel 091" was changed to "Expancel 461" (made by Expancel Co.), a toner was prepared. The toner was named to be a toner 9. The volume mean particle size D50 of the toner 9 was 29.3 μm and the particle size distribution index GSD was 1.44.

To the toner 9 was added 0.15% by weight silica $SiO_2$ having a mean particle size of 50 nm subjected to an HMDS treatment and the mixture was mixed using a Henschel mixer. Then, the toner was mixed with the carrier same as the carrier used in Example 1 such that the toner weight concentration became 15% by weight to prepare a developer 9.

(B) Evaluation by practical machine:

As the image output evaluation apparatus, a simultaneous two-color copying machine "Able 1401α" (made by FUJI XEROX CO., LTD.) was used. FIG. 4 shows the schematic cross-sectional view of the image output evaluation apparatus. In place of a color developer placed in the 1st developing apparatus of the copying machine, about 450 g of the developer 9 was placed. As a supplemental toner, about 60 g of the toner 9 added with the external additive was added. In the 2nd developing apparatus, about 700 g of an ordinary black toner for "Able 1401α" was placed. The established temperature of the fixing apparatus of the machine was about 20° C. raised over an ordinary temperature. When as a manuscript, the image wherein ordinary letters were shown by black and the portion which was intended to be copied as a Braille type and a map was shown by red was used, the ordinary letters became an ordinary copied image and the Braille type and the map became a convex three-dimensional image, and by one copying process, both the ordinary image and the three-dimensional image could be simultaneously obtained without lowering the resolving power of the ordinary letters. As the result of evaluating the three-dimensional image obtained as in Example 1, the image showed a sufficient image thickness and fixing property, etc., for practical use.

The results of evaluating the toners, the developers, and the three-dimensional images formed in Examples 1 to 7 and Comparative Examples 1 and 2 are shown in Table 1 below. The evaluation terms and the evaluation standards are shown below.

(1) Distribution of foaming agent in toner:

Using an electronmicroscope S800 (FE-SEM) made by Hitachi, Ltd., each toner was photographed at 1500 magnifications. In the enlarged photograph of the toner obtained, 50 toners were randomly selected, the presence and absence of the exposed foaming agent on the surface were evaluated by the following standards. In addition, the toners of G1 to G2 are defined to be "the toner wherein the foaming agent is not substantially exposed to the surface".

G1: In 50 toners, the number of the toner wherein the foaming agent particle was not exposed to the surface was 0.

G2: In 50 toners, the number of the toner wherein the foaming agent particle was not exposed to the surface was 1 to 10.

G3: In 50 toners, the number of the toner wherein the foaming agent particle was not exposed to the surface was 12 to 20.

G4: In 50 toners, the number of the toner wherein the foaming agent particle was not exposed to the surface was 21 to 30.

G5: In 50 toners, the number of the toner wherein the foaming agent particle was not exposed to the surface was 31 or more.

(2) Dispersed state of foaming agents in toner:

Using an electron microscope S800 (FE-SEM) made by Hitachi, Ltd., each toner was photographed at 1500 magnifications. In the enlarged photograph of the toner obtained, 20 toners were randomly selected, the dispersed state of the foaming agents in the toner was evaluated by the following standards.

G1: The foaming agents were very uniformed dispersed in the toner.

G2: The foaming agents were uniformly dispersed in the toner.

G3: The foaming agents were almost uniformly dispersed in the toner.

G4: The foaming agents were almost dispersed in the toner.

G5: The foaming agents were not dispersed in the toner but partially localized.

(3) Shape factor MLS2 of toner particle:

Using an electron microscope S800 (FE-SEM) made by Hitachi, Ltd., 100 toner images enlarged to 500 magnifications were randomly sampled, and the image information was introduced into an image analyzing apparatus (Luzex III) made by Nireco Co., via an interface and analyzed, and the shape factor MLS2 was calculated using the above-described equation (1).

(4) Particle size of toner (volume average diameter D50, particle size distribution GSD):

Using the apparatus formed by setting the aperture of Coultar Counter Type TA-II (made by Coultar Co.) to 100 μm was used and the particle size distribution of the toner was measured, the accumulated 50% value of the volume particle size distribution was defined to be the volume average diameter D50 and from the ratio of the accumulation 84% value D84 of the volume particle size distribution to the accumulation 16% value D16, $$\sqrt{D84/D16}$$

was defined to be the particle size distribution index GSD.

(5) Charging property:

About each toner used for a 2-component developer, the charged amount Q/M was measured by a blow-off method charged amount measuring apparatus TB500 (made by Toshiba Chemical Corp.). Also, Q/D was measured by CSG (charge-spectrograph method). It is preferred that the Q/M of the toner becomes from 4 to 10 μc/g and the Q/D becomes from 10 to 20 mm.

The Q/M of a one-component developer was measured using the blow-off method charged amount measuring apparatus TB500 (made by Toshiba Chemical Corp.) by incorporating 10% by weight the toner in a steel shot carrier of 100 μm (made by Powder Tec Co.) followed by stirring. The Q/D was measured same as the case of measuring the toner for the 2-component developer. It is preferred that the Q/M is from 0.5 to 4 μc/g and the Q/D is from 2 to 8 mm.

(6) Fixing property of fixed image:

A plain paper was stuck to a metal sheet of about 20 g and when each fixed image was rubbed with the paper at 5 times reciprocation, the spoiled extent of the paper was graded and the brittleness of the fixed image was evaluated.

G1: The plain paper was not spoiled and the fixing property was very good.

G2: The plain paper was spoiled a little to an extent of not visually recognized and the fixing property was good.

G3: The plain paper was spoiled a little to an extent of giving no problem for practical use.

G4: The plain paper was spoiled and the fixing property was inferior a little.

G5: The plain paper was greatly spoiled and the fixing property was inferior.

(7) Adhesive property of fixed image:

When the fixed image was rubbed at 5 times reciprocation as the case of (6), the released extent of the fixed image from the adhered surface of a paper was graded and the adhesive property of the fixed image to the paper was evaluated.

G1: The fixed image was not released and the adhesive property was very good.

G2: The fixed image was released a little to an extent of not recognized as an image defect, and the adhesive property was good.

G3: The fixed image was released a little to an extent of giving no problem for practical use.

G4: The fixed image was released and the adhesive property was inferior a little.

G5: The fixed image was severely released and the adhesive property was inferior.

(8) Image height:

Using a Surcom 1500 A surface roughness meter (made by Tokyo Seimitsu K.K.), 5 portions of the three-dimensional image were measured and the average value of them was employed as the image height.

(9) Braille point recognizability:

The three-dimensional-pattern image such as a Braille type image or map was stroked by 5 persons, the feelings were graded and evaluated, and the average value was shown by the grade value.

G1: The three-dimensional image was recognized very good.

G2: The three-dimensional image was recognized good.

G3: The three-dimensional image was recognized.

G4: The three-dimensional image could not partially be recognized.

G5: The three-dimensional image could not be recognized.

The results are shown in following Table 1.

TABLE 1

| | | Characteristics of Toner | | | | | Characteristics of developer | | Image characteristics | | | | | |
|---|---|---|---|---|---|---|---|---|---|---|---|---|---|---|
| | Toner No. Developer No. | D50 (μm) | GSD | Shape factor ML2 | Exposure of foaming agent | Dispersed state of foaming agent | Q/M μc/g | Q/D Peak mm | Image height μm | Braille type recognition | Brittleness of fixed toner image | Adhesive property of fixed toner image | Image quality maintenance | Fogging property under low temperature and low humidity |
| Example 1 | Toner 1 Developer 1 | 30.2 | 1.42 | 125 | G1 | G1 | 6 | 15 | 200 | G1 | G1 | G1 | G1 | G1 |

TABLE 1-continued

| | | Characteristics of Toner | | | | | Characteristics of developer | | Image characteristics | | | | | |
|---|---|---|---|---|---|---|---|---|---|---|---|---|---|---|
| | Toner No. Developer No. | D50 (μm) | GSD | Shape factor ML2 | Exposure of foaming agent | Dispersed state of foaming agent | Q/M μc/g | Q/D Peak mm | Image height μm | Braille type recognition | Brittleness of fixed toner image | Adhesive property of fixed toner image | Image quality maintenance | Fogging property under low temperature and low humidity |
| Example 2 | Toner 2 Developer 2 | 32 | 1.5 | 130 | G2 | G2 | 1.5 | 4 | 180 | G2 | G2 | G2 | G1 | G1 |
| Example 3 | Toner 3 Developer 3 | 28.5 | 1.38 | 125 | G1 | G1 | 2 | 5 | 180 | G1 | G1 | G1 | G1 | G1 |
| Example 4 | Toner 4 Developer 4 | 29 | 1.35 | 123 | G1 | G1 | 7 | 18 | 210 | G1 | G1 | G1 | G1 | G1 |
| Example 5 | Toner 5 Developer 5 | 35 | 1.4 | 110 | G2 | G2 | 6.5 | 17 | 160 | G2 | G2 | G3 | G1 | G1 |
| Comparative Example 6 | Toner 6 Developer 6 | 28.3 | 1.35 | 122 | — | — | 7 | 17 | 190 | G1 | G5 | G4 | G4 | G5 |
| Comparative Example 7 | Toner 7 Developer 7 | 28.0 | 1.36 | 145 | G5 | G1 | 5 | 15 | 50 | G5 | G3 | G3 | G4 | G5 |
| Example 6 | Toner 8 Developer 8 | 30.5 | 1.45 | 122 | G1 | G1 | 6.4 | 16 | 210 | G1 | G1 | G1 | G1 | G1 |
| Example 7 | Toner 9 Developer 9 | 29.3 | 1.44 | 124 | G1 | G1 | 5.5 | 12 | 250 | G1 | G1 | G1 | G1 | G1 |

As described above, by using the toner of this invention, a three-dimensional image which can be recognized as a Braille type can be formed with a sufficient strength for practical use without scarcely modifying a copying machine or a printer of an ordinary electrophotographic system widely used in mainly offices. Also, many sheets of three-dimensional images can be stably prepared with the easiness same as ordinary copies.

Also, according to the method of the preparation of toner of this invention, a toner having a sufficient foaming property can be efficiently and easily prepared. The three-dimensional image-forming method and the image-forming apparatus of this invention can easily and stably provide images having a sufficient image thickness and a good fixing property to a plain paper, etc., without using complicated processes and complicated means.

What is claimed is:

1. An image-forming toner comprising at least a binder resin and a foaming agent, wherein the foaming agent is not substantially exposed to the surface of the toner.

2. An image-forming toner as claimed in claim 1, wherein the foaming agent comprises microcapsule particles containing a substance having a low-boiling temperature.

3. An image-forming toner as claimed in claim 2, wherein the substance is isobutane.

4. An image-forming toner as claimed in claim 2, wherein the shell material of the microcapsule particles comprises a copolymer of vinylidene chloride and acrylonitrile.

5. A method of preparing an image-forming toner comprising a step of suspension-dispersing an oil phase formed by dissolving and/or dispersing at least a binder resin and a foaming agent in a solvent in an aqueous phase to prepare particles made up of the oil phase and a step of removing the solvent from the particles.

6. A method of preparing an image-forming toner comprising a step of suspension-polymerizing a monomer for a binder resin and dissolving or dispersing therein at least a foaming agent in an aqueous phase.

7. A method of forming a three-dimensional image containing a step of fixing an image comprising a toner formed on a recording medium, wherein the toner is a toner comprising at least a binder resin and a foaming agent, said foaming agent being not substantially exposed to the surface of the toner, and in the fixing step, the foaming agent contained in the toner is foamed to form a three-dimensional image on the recording medium.

8. A method of forming a three-dimensional image having a developing step of developing an electrostatic latent image formed on an electrostatic latent image holder with a toner to form a toner image and a transfer step of transferring the toner image onto a recording medium, and a fixing step of fixing the toner image to the recording medium, wherein the toner comprises at least a binder resin and a foaming agent, said foaming agent being not substantially exposed to the surface of the toner, and in the fixing step, the foaming agent contained in the toner is foamed to form a three-dimensional image on the recording medium.

9. A method of forming a three-dimensional image as claimed in claim 8, wherein the developing step develops electrostatic latent images using plural developing apparatuses and plural toner images are formed on the recording medium, wherein the toner is used for at least one developing apparatus.

10. A method of forming a three-dimensional image as claimed in claim 8, wherein the developing step develops electrostatic latent images using plural developing apparatuses and plural toner images are formed on the recording medium the toner is used for at least one developing apparatus and developing the image-forming toner by selecting the developing apparatus containing the toner.

11. An image-forming apparatus comprising a developing unit of developing an electrostatic latent image formed on an electrostatic latent image holder with a toner to form a toner image, a transfer unit of transferring the toner image on a recording medium, and a fixing unit of fixing the toner image to the recording medium, wherein the toner comprises at least a binder resin and a foaming agent, said foaming agent being not substantially exposed to the surface of the toner, and the fixing means foams the foaming agent contained in the toner to form a three-dimensional image on the recording medium.

* * * * *